US007987987B1

(12) United States Patent
Rochelo

(10) Patent No.: US 7,987,987 B1
(45) Date of Patent: Aug. 2, 2011

(54) PRODUCT DISPLAY SYSTEM HAVING AN INTEGRAL PROTECTIVE CASE FOR HOUSING AND DISPLAYING A PRODUCT

(76) Inventor: Donald R. Rochelo, Pittsfield, MA (US)

( * ) Notice: Subject to any disclaimer, the term of this patent is extended or adjusted under 35 U.S.C. 154(b) by 0 days.

(21) Appl. No.: 13/008,212

(22) Filed: Jan. 18, 2011

Related U.S. Application Data

(60) Provisional application No. 61/336,066, filed on Jan. 15, 2010.

(51) Int. Cl.
*B65D 73/00* (2006.01)

(52) U.S. Cl. ..... 206/701; 206/462; 206/779

(58) Field of Classification Search ..... 206/763, 206/769, 461, 462, 463, 775, 779, 784, 701, 206/722
See application file for complete search history.

(56) References Cited

U.S. PATENT DOCUMENTS 3,352,409 A * 11/1967 Link ..... 206/763
4,234,084 A 11/1980 Hutten
4,469,226 A 9/1984 Matney
5,370,223 A 12/1994 Leicht, Jr.
6,053,320 A * 4/2000 Kuethe ..... 206/462
7,494,012 B1 2/2009 Priebe et al.
2007/0029223 A1 * 2/2007 Mazurek ..... 206/463
2007/0062836 A1 * 3/2007 Nazari ..... 206/461
2007/0187273 A1 * 8/2007 Grosskopf ..... 206/462

* cited by examiner

*Primary Examiner* — Jacob K Ackun, Jr.
(74) *Attorney, Agent, or Firm* — Malcolm J. Chisholm, Jr.

(57) ABSTRACT

A bi-layer product package (12) includes a protective case (20) secured between opposed display and backing layers (14, 16) of the product package (12). A product display base (24) of the case projects through a display void (18) of the display layer (14) and houses a product (30). A capture lid (22) and twist-off securing structures (32, 40A, 40B, 42) of the case are secured between the display and backing layers (14, 16) of the package (12) to prevent the display base (24) from passing completely through the display layer (14). The display base (24) replaces a traditional transparent blister or projection of a blister pack during display of the product (30), and during usage of the product (30), thereby minimizing materials and manufacturing costs, while providing in one package (12) both a product (30) and a removable protective case (20) integral with the package (12).

5 Claims, 2 Drawing Sheets

PRODUCT DISPLAY SYSTEM HAVING AN INTEGRAL PROTECTIVE CASE FOR HOUSING AND DISPLAYING A PRODUCT

CROSS REFERENCE TO RELATED APPLICATION

This Application claims the benefit of U.S. Provisional Patent Application Ser. No. 61/336,066 that was filed on Jan. 15, 2010, entitled "Product Display System Having an Integral Protective Case for Housing and Displaying a Product".

TECHNICAL FIELD

The present invention relates to "blister pack" types of packaging, and in particular relates to a package with an integral protective case for housing, displaying and protecting a product such as a portable memory card.

BACKGROUND ART

It is well known that memory devices for storage of data for modern electronic components, such as computers, cameras, entertainment systems, etc., are becoming increasingly smaller. For example, solid memory technology components currently and commonly referred to in the art as "memory cards@ may be readily secured in containers or cases as small as one inch in length and width and one-quarter inch in depth or smaller. Such small memory devices provide substantial conveniences in storing, backing-up and transferring data such as computer programs, visual images, audio data, etc. Because such memory devices are so small, however, they also give rise to significant risks related to transport of the devices. For example, dropping of the devices could damage them; exposure to moisture could likewise injure them; or contact of data transfer ports of the devices with foreign objects could also harm them.

It is known that some modern protective carriers exist for solid memory devices, such as a memory card protective carrier disclosed in U.S. Pat. No. 6,230,885 that issued on May 15, 2001 to the owners of all rights in the invention described herein, which patent is hereby incorporated herein by reference. Similarly, U.S. Pat. No. 6,739,452 that issued on May 25, 2009, and that is also co-owned and also incorporated herein by reference, shows a rigid exterior shell housing soft resilient inserts within the shell to completely enclose a memory device and thereby protect it against damage from impact or fluid contamination.

Such small memory cards are quite valuable and because they are so small, they present a security risk when displayed for retail sale. Therefore, it has become common to display such a small memory cards in display packages referred to as "blister packs". A blister pack includes a front display layer and an opposed, adjacent solid backing layer, wherein the memory card or product is housed for display within a blister or protrusion of transparent plastic projecting out of the display layer of the blister pack. Such blister packs may therefore securely store small, valuable products while minimizing shop-lifting security risks by having the display and backing surfaces sufficiently large to carry security alarm activators, to make access and deposit in a shop-lifter's pocket easily visible, and to also enhance areas for display of technical information and/or product advertising.

It is also known that traditional blister packs may be utilized to house a product container. Such use of a blister pack is shown in U.S. Pat. No. 4,234,084 to Hutten. The blister pack therein includes a removable, reusable container that is within with the protrusion of the blister pack. Additionally, U.S. Pat. No. 5,370,223 to Leicht, Jr. shows a collectable car container mounted within a blister pack; U.S. Pat. No. 4,469,226 to Matney likewise shows a reusable container within a blister pack; U.S. Pat. No. 7,494,012 to Priebe et al. also shows a blister pack securing a complex pill container.

While such known blister packs may effectively house and display a container, nonetheless known blister packs require a blister or protrusion of transparent plastic material within which the product or case is housed for display. Manufacture of such plastic blisters typically requires integration of a small plastic component with cardboard or paper of the display and backing layers, or requires a complicated mold to define the blister for an all plastic blister pack. All of this increases materials and manufacturing costs for producing the blister pack.

Accordingly, there is a need for a product display system that more efficiently protects and displays a product.

SUMMARY OF THE INVENTION

The invention is a product display system having an integral protective case for housing and displaying a product. The display system includes a bi-layer product package having a display layer and an opposed backing layer secured adjacent the display layer. The display layer defines a product display void surrounded by the display layer. The system also includes a protective case including a capture lid pivotally secured to a product display base, wherein the base is surrounded on all sides by a product containing wall to define a product chamber so that the product may be housed within the product chamber between the display base, the containing wall and the capture lid. The protective case also includes a catch-lip projecting from the containing wall in direction away from the product chamber.

The capture lid of the case is dimensioned to be secured in an open position pivoted away from the product chamber between the display layer and backing layer of the bi-layer product package. The product display base of the protective case is configured to project through the product display void of the display layer of the product package so that the product display base extends through the display void in a direction away from the display layer and backing layer. Additionally, the product display void and protective case are cooperatively dimensioned so that the catch-lip is secured between the display layer and backing layer whenever the product display base projects through the product display void so that the product is thereby housed for display within the product chamber between the display base and the backing layer. More specifically the product display void is dimensioned to have a virtually identical perimeter to a perimeter of the product display base.

Therefore, whenever the product display base of the protective case projects through the product display void, the capture lid and catch-lip of the protective case are captured between the display layer and backing layer of the bi-layer product package to prevent the product display base from passing completely through the product display void, so that the product remains housed within the base of the case and cannot fall out of the bi-layer product package.

In use of the product display system, whenever the product display base of the protective case projects through the product display void, the capture lid and catch-lip of the protective case are securely captured between the display layer and backing layer of the bi-layer product package to prevent the product display base from passing completely through the product display void. In this way, the product remains housed within the product chamber of the case and cannot fall out of the bi-layer product package.

By integrating the protective case with the bi-layer product package, the cost and complexity of combining a transparent plastic window to the display layer is obviated. Additionally, instead of disposing of a transparent, rigid plastic window with the display and backing layers, a purchaser of the product within the product package receives a protective case, separable from the bi-layer product package that the purchaser may utilize to protect and house the product. Therefore, the present product display system not only minimizes manufacturing materials, complexity and costs of production and assembly of a package, but also the product display system provides the purchaser with a valuable protective case that previously served as an integral component of the efficient bi-layer product package. It is to be understood that the display base is preferably transparent, such as common plastics used in known cases.

Accordingly, it is a general purpose of the present invention to provide a product display system having an integral protective case for housing and displaying a product that overcomes deficiencies of the prior art.

It is a more specific purpose to provide a product display system having an integral protective case for housing and displaying a product that decreases required materials and manufacturing costs in production of the product display system.

These and other purposes and advantages of the present product display system having an integral protective case for housing and displaying a product will become more readily apparent when the following description is read in conjunction with the accompanying drawings.

DESCRIPTION OF THE PREFERRED EMBODIMENTS

Figure 1:
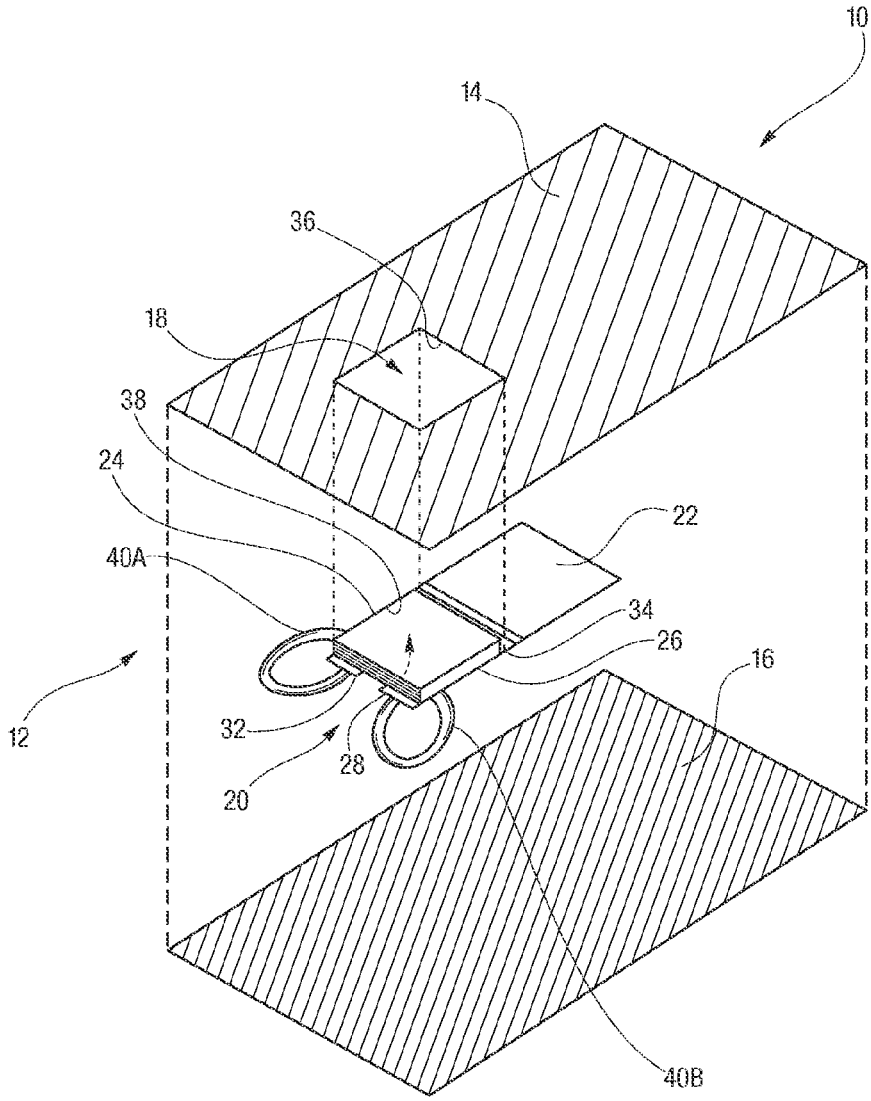
FIG. 1 is an exploded perspective view of a simplified product display system having an integral protective case for housing and displaying a product constructed in accordance with the present invention.
Figure 2:
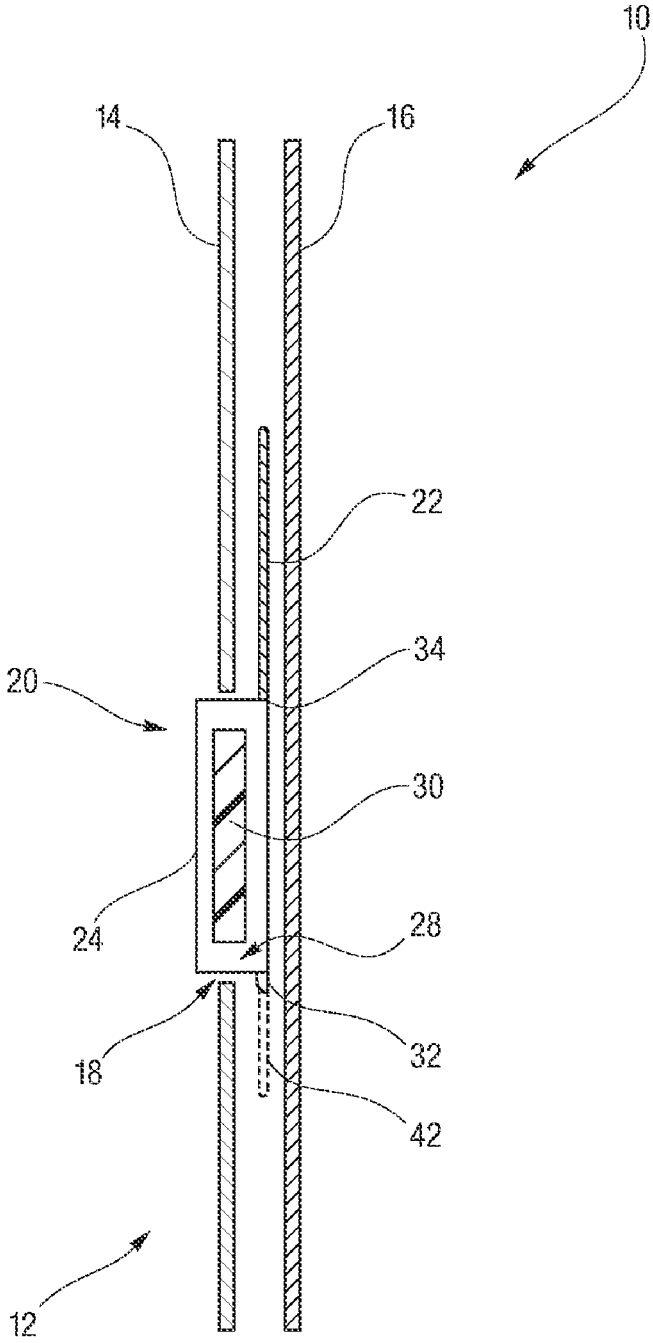
FIG. 2 is a cross-section, side plan view of a product display system having an integral protective case for housing and displaying a product and showing a schematic representation of a product housed within product chamber of the product display system.

Referring to the drawings in detail, a product display system having an integral protective case for housing and displaying a product is shown in FIG. 1, and is generally designated by the reference numeral 10. The display system 10 includes a bi-layer product package 12 having a display layer 14 and an opposed backing layer secured adjacent the display layer 14. The display layer 14 defines a product display void 18 surrounded by the display layer 14. The system 10 also includes a protective case 20 including a capture lid 22 pivotally secured to a product display base 24, wherein the base 24 is surrounded on all sides by a product containing wall 26 to define a product chamber 28 so that the product 30 (shown in only in FIG. 2) may be housed within the product chamber 28 between the display base 24, the containing wall 26 and the backing layer 16 whenever the case 20 is disposed in an open position within the system 10 (as shown in FIG. 1 and FIG. 2. Whenever the case 20 is disposed in a closed position (not shown), the product is housed between the display base 24, the containing wall 26 and the capture lid 22. The protective case 20 also includes a catch-lip 32 projecting from the containing wall 26 in direction away from the product chamber 28.

The capture lid 22 of the case 20 is dimensioned to be secured in the open position pivoted away from the product chamber 28 between the display layer 14 and backing layer 16 of the bi-layer product package 12. In both FIG. 1 and FIG. 2 the capture lid 22 is shown pivoted about a case hinge 34 into the open position so that the lid 22 extends away from the display base 24. As best shown in FIG. 2, the product display base 24 of the protective case 20 is configured to project through the product display void 18 of the display layer 14 of the bi-layer product package 12 so that the product display base 24 extends through the display void 18 in a direction away from the display layer 14 and backing layer 16.

Additionally, the product display void 18 and protective case 20 are cooperatively dimensioned so that the catch-lip 32 is secured between the display layer 14 and the backing layer 16 whenever the product display base 24 projects through the product display void 18 so that the product 30 is thereby housed for display within the product chamber 28 between the display base 24 and the backing layer 16. To be effective, the product display void 18 must be dimensioned to have a virtually identical perimeter 36 to a product display base 24 perimeter 38.

In use of the product display system 10, whenever the product display base 24 of the protective case projects through the product display void 18, the capture lid 22 and catch-lip 32 of the protective case 20 are securely captured between the display layer 14 and backing layer 16 of the bi-layer product package 12 to prevent the product display base 24 from passing completely through the product display void 18. In this way, the product 30 remains housed within the product chamber 28 of the case 20 and cannot fall out of the bi-layer product package 12.

Whenever the display layer 14 and backing layer 16 of the bi-layer product package 12 are secured adjacent each other, the two layers 14, 16 are firmly secured such as by an adhesive, bonding agent, thermal or compression joining of plastic materials, or other adhering methods known in the art. Both FIG. 1 and FIG. 2 show the display layer 14 and backing layer 16 disposed away from each other for efficiency of explanation of the described components. However, when a product 30, such as memory card or any product, is secured within the product chamber of the protective case 20, the front layer 14 and opposed backing layer 16 are firmly secured to each other and to opposed surfaces of the capture lid 22 and catch-lip 32 so that extraction of the protective case 20 from the product package 12 requires tearing apart the two layers 14, 16, or cutting them such as with scissors (not shown) to extract the protective case 20.

By integrating the protective case 20 with the bi-layer product package 12 the cost and complexity of combining a transparent plastic window (not shown) to the display layer 14 is obviated. Additionally, a purchaser (not shown) of the product 30 within the product package 12, instead of disposing of a transparent, rigid plastic window with the layers 14, 16, the purchaser instead receives a protective case, separable from the bi-layer product package 12, that the purchaser may utilize to protect and house the product 30. Therefore, the present product display system 10 not only minimizes manufacturing materials, complexity and costs of production and assembly of a package, but also the product display system 10 provides the purchaser with a valuable protective case 20 that previously served as an integral component of the efficient bi-layer product package 12. It is to be understood that the display base 24 is preferably transparent, such as common plastics used in known cases.

Additionally, while the aforesaid description describes the catch-lip 32 as a component captured between the display layer 14 and backing layer 16, additional securing structure means for securing the display base 24 between the display layer 14 and the backing layer 16 may be utilized. Such alternative or additional securing means may include structures such as twist-off anti-theft loops 40A, 40B (shown in FIG. 1) extending away from a portion, portions, or all of the product containing wall 26 to be secured between the display and backing layers 14, 16. Further alternative securing structure means may include a twist-off extension tab(s) 42 extending away from a portion, portions, or all of the product containing wall 26 or any other aspect of the protective case 20, such as from the catch-lip 32, as shown in FIG. 2. Such twist-off anti-theft loops 40A, 40B and/or security extension tab(s) 42 may extend from the product display base 24 or wall 26 thereof to be secured between the display layer 14 and backing layer 16 to further secure the display base 24 between the display layer 14 and backing layer 16 and to thereby make sure the product display base 24 may not be pushed out of the product display void 18 to allow unauthorized removal of the product 30. After a purchaser properly acquires the bi-layer product package 12 and separates the display and backing layers 14, 16, and then removes the protective case 20, any such securing structures 40A, 40B, 42 may be removed from the display base 24 or containing wall 26 by twist-off techniques common to plastic products, by use of a cutting tool, or by any other removal technique known in the art.

While the present product display system 10, invention has been disclosed with respect to the described and illustrated embodiments, it is to be understood that the invention is not to be limited to those embodiments. Accordingly, reference should be made primarily to the following claims rather than the foregoing description to determine the scope of the invention.

What is claimed is:

1. A product display system having an integral protective case for housing and displaying a product, the system comprising:

a. a bi-layer product package including a display layer and an opposed backing layer secured adjacent the display layer, wherein the display layer defines a product display void surrounded by the display layer;

b. a protective case including a capture lid pivotally secured to a product display base, wherein the base is surrounded on all sides by a product containing wall to define a product chamber so that the product may be housed within the product chamber between the display base, the containing wall and the capture lid whenever the protective case is disposed in a closed position, the protective case also including a securing structure means projecting from the containing wall in a direction away from the product chamber, the securing structure means being for securing the display base of the protective case between the display layer and backing layer of the product package; and, c. wherein the capture lid of the case is dimensioned to be secured in an open position pivoted away from the product chamber between the display layer and backing layer of the bi-layer product package, and the product display base of the protective case is configured to project through the product display void of the display layer of the product package so that the product display base extends through the display void in a direction away from the display layer and backing layer, and wherein the product display void and protective case are cooperatively dimensioned so that the securing structure means is secured between the display layer and backing layer whenever the product display base projects through the product display void so that the product is thereby housed for display within the product chamber between the display base, the product containing wall and the backing layer.

2. The product display system of claim 1, wherein the securing structure means comprises a catch-lip projecting from the product containing wall in a direction away from the product chamber.

3. The product display system of claim 1, wherein the securing structure means comprises at least one twist-off anti-theft loop projecting from the product containing wall in a direction away from the product chamber.

4. The product display system of claim 1, wherein the securing structure means comprises at least one twist-off extension tab projecting from the product containing wall in a direction away from the product chamber.

5. The product display system of claim 1, wherein the display layer of the bi-layer product package is hinged to the backing layer of the product package.

* * * * *